United States Patent [19]

Engel et al.

[11] 4,068,058

[45] Jan. 10, 1978

[54] AMINATED POLYMERIC ADDITIVES FOR FUEL AND LUBRICANTS

[75] Inventors: Lawrence J. Engel, Green Brook; John B. Gardiner, Mountainside, both of N.J.

[73] Assignee: Exxon Research and Engineering Company, Linden, N.J.

[21] Appl. No.: 555,575

[22] Filed: Mar. 5, 1975

[51] Int. Cl.[2] ..... C10M 1/32

[52] U.S. Cl. ..... 526/49; 252/51.5 A; 252/55; 526/19; 526/58

[58] Field of Search ..... 252/51.5 A, 51.5 R, 252/55; 260/878 R, 80.3 N; 526/19, 49, 58

[56] References Cited

U.S. PATENT DOCUMENTS

| | | | |
|---|---|---|---|
| 3,076,791 | 2/1963 | Hollyday et al. | 252/51.5 R X |
| 3,378,492 | 4/1968 | Song et al. | 252/50 |
| 3,388,067 | 6/1968 | Takashima et al. | 252/55 |
| 3,687,849 | 8/1972 | Abbott | 252/51.5 A X |
| 3,756,954 | 9/1973 | Abbott et al. | 252/55 |
| 3,769,216 | 10/1973 | Gordon et al. | 252/51.5 A X |
| 3,864,268 | 2/1975 | Culbertson et al. | 252/51.5 R |

*Primary Examiner*—Delbert E. Gantz
*Assistant Examiner*—Andrew H. Metz
*Attorney, Agent, or Firm*—Roland A. Dexter

[57] ABSTRACT

Hydrocarbon polymers, optimally, copolymers having a degree of crystallinity of up to 25 weight percent, comprising about 2 to 98 mole percent ethylene, and one or more $C_3$ to $C_{28}$ alpha-olefins are mechanically grafted at elevated temperatures, under an inert atmosphere, to form an aminated polymer which is thereafter mechanically-oxidatively degraded at an elevated temperature in the presence of air or oxygen-containing gas to form an aminated polymeric reaction product. The resulting aminated polymers are useful as sludge dispersants for fuels and lubricants. When the aminated polymers have a high molecular weight, they are also useful as viscosity-index improvers with dispersant and/or pour point depressant activity.

5 Claims, No Drawings

AMINATED POLYMERIC ADDITIVES FOR FUEL AND LUBRICANTS

BACKGROUND OF THE INVENTION

1. Field of the Invention

This invention relates to polymeric dispersant additives for lubricants and hydrocarbon fuels. When of higher molecular weight, the additives are also useful as multifunctional viscosity-index improvers for lubricants. More particularly, this invention relates to hydrocarbon polymers such as tertiary hydrogen-containing or alpha olefin polymers and, in particularly, ethylene copolymers having a degree of crystallinity of less than about 25 weight percent as determined by X-ray or differential thermal analyses and comprising from about 2 to 98 parts by weight of ethylene and one or more $C_3$ to $C_{28}$ alpha olefins, usually propylene, which have been grafted by mechanical action as by intensive milling at an elevated temperature and in an inert atmosphere but in the presence of an amine compound to form an aminated polymer which is thereafter mechanically-oxidatively degraded as by intensive milling at an elevated temperature, usually in the absence of a solvent or fluxing medium and in the presence of air or oxygen-containing gas to form an aminated polymeric reaction product of reduced average molecular weight.

2. Description of the Prior Art

A variety of polymeric materials which incorporate nitrogen have been described in U.S. and foreign patents as dispersants for fuels and lubricants, and as viscosity index improvers for lubricants. For example:

U.S. Pat. No. 3,076,791 improves the pour point depressant activity of polymeric V.I. improvers by subjecting polymers and amines to shearing forces so as to effect degradation of the polymer whereby the pour point depressant activity was enhanced.

U.S. Pat. No. 3,404,091 grafts polar monomers, such as acrylonitrile onto hydroperoxidized copolymers of ethylene and propylene.

U.S. Pat. No. 3,404,092 reacts hydroxylated ethylene-propylene copolymers with isocyanates.

U.S. Pat. No. 3,687,849 grafts various unsaturated monomers onto a degraded, hydroperoxidized, interpolymer of ethylene and propylene.

U.S. Pat. No. 3,769,216 shows an atactic (i.e., non-crystalline) copolymer of ethylene and propylene containing from 45 to 65 mole percent of ethylene, mechanically degraded in the presence of oxygen, followed by reaction with a polyamine.

U.S. Pat. No. 3,785,980 discloses the reaction product of an amine with a hydroperoxidized atactic copolymer of ethylene and propylene containing from 45 to 65 mole percent of ethylene.

British Pat. No. 1,172,818 described the preparation of lube oil additives by the condensation of an amine with an oxidized, e.g., ozonized, polymer.

SUMMRY OF THE INVENTION

Our copending U.S. Patent application Ser. No. 493,328 filed July 31, 1974 is directed to amorphous copolymers having up to 80 mole percent ethylene which are oxidized by mastication in the presence of air, followed by reaction with a less than stoichiometric amount of amine, e.g., tetraethylene pentamine.

In contrast to the prior art and our copending application, it has been discovered that hydrocarbon polymers can be tailored as desired in nitrogen content and molecular weight by a process wherein the amount of amination is controlled independently of oxidation with very slight polymer degradation and adjustment of the molecular weight is thereafter possible without reduction of polymer nitrogen content to provide a final product having the desired additive properties. This is achieved by a process for the production of an oil-soluble sludge dispersing, viscosity index improving additive for hydrocarbon fuels and lubricants which comprises: (a) mechanically shearing a hydrocarbon polymer to incorporate at least 0.001 weight percent nitrogen in said polymer, in the absence of an oxygen-containing gas and in the presence of an amine compound, said polymer optimally being a copolymer of ethylene and one or more $C_3$ to $C_{28}$ alpha-olefins; and (b) thereafter, mechanically-oxidatively degrading said aminated polymer in the absence of a solvent and in he presence on an oxygen-containing gas; both of said steps being carried out at elevated temperatures in the range of 95° C. to 260° C.

The inert environment which is required for the amino-grafting step should be free of oxygen, that is, no substantial polymer oxidation should occur during the mechanically induced grafting of the polymer. No substantial oxidation is defined for the purposes of this invention as the introduction of less than about 0.05 weight percent, preferably less than about 0.01 weight percent, of oxygen into the amino-grafted polymer. These novel aminated polymer additives of the invention will contain from about one-thousandth of a percent of nitrogen to a maximum 25 percent by weight of nitrogen. For the aminated polymeric additives of higher molecular weight, $\overline{M}_n$, of from about 10,000 to about 500,000 (useful for pour depressant and/or V.I. improving) the nitrogen content ranges from about 0.001 to 5 weight percent, preferably 0.01 to 0.5 weight percent; for additives of lower molecular weights $\overline{M}_n$ of less than about 10,000, i.e., at least about 700 (useful in pour depressant and/or dispersant) the nitrogen content ranges broadly from about 0.001 to 25 weight percent, preferably from 0.01 to 8 weight percent. The unique advantages of the present invention include the features that there is no significant degradation of polymer chain length during the amino-grfting of the polymer and that the amount of nitrogen incorporated into the polymer appears limited only by the concentration of the amine and the time and temperature of the mechanically induced grafting and that the average molecular weight of the amino-grafted polymer can be adjusted by the mechanical-oxidative degradation step independent of the step of amination.

DESCRIPTION OF PREFERRED EMBODIMENTS

I. The Polymer

As earlier indicated any hydrocarbon polymer, e.g. polyisobutylene, would be suitable for the use in this process. The preferred polymers are tertiary hydrogen-containing or alpha olefin polymers such as ethylene-propylene copolymers, polyethylene, polypropylene, partially hydrogenated (random or block), polymers of styrene-butadiene, styrene-isoprene and styrene-butadiene-isoprene.

Particularly preferred are those copolymers containing from about 2 to about 98 weight percent of ethylene and one or more $C_3$ to $C_{28}$ alpha olefins, preferably propylene, which have a degree of crystallinity of less than about 25 weight percent as determined by X-ray and differential scanning calorimetry and have a weight average molecular weight ($\overline{M}_w$) in the range of about 2,000 to about 800,000 and a number average molecular weight ($\overline{M}_n$) in the range of about 700 to 250,000 and a range of molecular weight as measured by the ratio of $\overline{M}_w/\overline{M}_n$ of less than about 8. These ethylene copolymers may be readily prepared using soluble Ziegler-Natta catalyst compositions, which are well known in the art. For recent reviews of the literature and patent art see: Rubber Chem. & Tech. Vol. 45, No. 3, 709–881, (1972) and "Polymer Chemistry of Synthetic Elastomers," edited by Kennedy and Tornqvist, Interscience, N.Y. 1969.

Suitable copolymers may be prepared in either batch or continuous reactor systems. In common with all Ziegler-Natta polymerizations, monomers, solvents and catalyst components are dried and freed from moisture, oxygen or other constituents which are known to be harmful to the activity of the catalyst system. The feed tanks, lines and reactors may be protected by blanketing with an inert dry gas such as purified nitrogen. Chain propagation retarders or stoppers, such as hydrogen and anhydrous hydrogen chloride, may be fed continuously or intermittently to the reactor for the purpose of controlling the molecular weight within the desired limits and the degree of crystallinity known to be optimum for the end product.

In addition to ethylene and propylene which are available commercially in a state of purity designated "polymerization grade", other olefins which are useful for the preparation of these copolymers include: 1-butene, 1-pentene, 1-hexene and 1-octene. Branched chain alpha-olefins, such as 5-methylpentene-1 and 6-methylheptene-1, may also be utilized as well as longer carbon chains.

Media for dissolving or dispersing the catalyst components and copolymer reaction products, and for heat exchange, may be selected from the general group of saturated petroleum hydrocarbons and halogenated hydrocarbons. $C_{12}$ or lower, straight or branched chain hydrocarbons are preferred. However, $C_5$ to $C_9$ saturated alicyclic, or $C_6$ to $C_9$ aromtic hydrocarbons may be used with equal facility. Equally uuseful are halogenated hydrocarbons having two to six carbon atoms in the molecule. Representative non-limiting examples of solvents, which are also useful for removal of the heat of reaction, include: propane, butane, pentane, hexane, cyclopentane, heptane, cyclohexane, methyl cyclopentane, n-heptane, methyl cyclohexane, isooctane, benzene, toluene, mixed xylenes, sym-dichloroethane, trichloroethane and ortio-dichlorobenzene.

Principal Ziegler-Natta catalysts, useful in the synthesis of suitable copolymers of this invention, are selected from the group of transition metal compounds comprising Groups IVb, Vb and VIb of the Periodic Table of the Elements. Particularly useful are compounds of vanadium and titanium. Most preferred are compounds of vanadium having the general formula $VO_zX_t$, wherein $z$ has a value of 0 or 1, $t$ has a value of 2 to 4 and X is independently selected from the group consisting of halogens having an atomic number equal to or greater than 17 (Cl, Br and I), acetylacetonates, haloacetylacetonates, alkoxides and haloalkoxides. Non-limiting examples of such catalysts are: $VOCl_3$; $VO(AcAc)_2$; $VOCl_2(OBu)$; $V(AcAc)_3$ and $VOCl_2$ AcAc; where Bu is butyl and AcAc is an acetylacetonate.

Titanium compounds, which are best used in combination with vanadium compounds, have the general formula $Ti(OR)_4$, wherein R is an acyclic, or alicyclic, monovalent hydrocarbon radical of 1 to 12 carbon atoms.

Most preferred among the principal catalysts are: vanadyl trichloride ($VOCl_3$), and tetrabutyl titanate ($Ti(OBu)_4$) used in combination with $VOCl_3$.

Ziegler-Natta cocatalysts, for use with the above principal catalysts, comprise organometallic reducing compounds from Groups IIa, IIb and IIIa of the Periodic Table of the Elements. Particularly useful are the organoaluminum compounds having the general formula $AlR'_mX'_n$, wherein R' is a monovalent hydrocarbon radical selected from the group consisting of $C_1$ to $C_{12}$ alkyl; $C_6$ to $C_{12}$ alkylaryl and arylalkyl; and $C_5$ to $C_{12}$ cycloalkyl radicals, wherein $m$ is a number from 1 to 3, X' is halogen having an atomic number equal to or greater than 17, and the sum of $m$ and $n$ is equal to three.

Non-limiting examples of useful cocatalysts are: $Al(Et)_3$; $Al(isoBu)_3$; $EtAl(Cl)_2$; $Et_2AlCl$; and $Et_3Al_2Cl_3$.

The temperature at which the polymerization is conducted can influence the stability of the catalyst species present in the reaction, with a corresponding influence on the rate of polymerization and the molecular weight of the polymer which is formed. Suitable temperatures are in the range of −40° C. to 100° C., preferably 10° C. to 80° C., most preferably about 20° C. to 60° C.

The pressure at which the polymerization is conducted will depend on the solvent, the temperature which is maintained in the reaction milieu and the rate that monomers are fed to the reactor. In the preferred temperature range, a pressure in the range of about 0 to 150 psig has given satisfactory results.

Molecular weight may be regulated by choice of solvent, monomer, principal catalyst concentration, temperature, the nature and amount of the cocatalyst, e.g., aluminum alkyl cocatalyst concentration, and whether a chain transfer reagent such as hydrogen is employed.

Polymerization may be effected to produce the high ethylene content copolymers used in the invention. By passing 0.1 to 15, for example 5 parts of ethylene; 0.05 to 10, for example 2.5 parts of higher alpha-olefin, typically propylene; and from 10 to 10,000 parts of hydrogen per million parts of ethylene; into 100 parts of an inert liquid solvent containing (a) from about 0.0017 to 0.017, for example 0.0086 parts of a transition metal principal catalyst, for example $VOCl_3$; and (b) from about 0.0084 to 0.084, for example 0.042 parts of cocatalyst, such as $(C_2H_5)_3Al_2Cl_3$; at a temperature of about 25° C. and a pressure of 60 psig. for a period of time sufficient to effect optimum conversion, for example, 15 minutes to one-half hour.

Since the reactivity of the higher alpha-olefin and rate in which it is incorporated into the copolymer is less than it is for ethylene, it is desirable to feed somewhat more than the theoretical proportions of higher alpha-olefin to obtain a copolymer having the desired ethylene content.

Conventional procedures, well known in the art may be used for recovery of the polymer from the reaction mixture leaving the reactor. The polymer "cement" issuing from the reactor may be quenched with a lower alcohol such as methanol or isopropanol. A chelating agent can be added to solubilize the catalyst residues, and the polymer recovered as an aqueous slurry by steam stripping. The resulting wet crumb may be purified by filtration, and then dried at a moderately elevated temperature under vacuum.

II Amine Compound

Useful amine compounds for grafting into the hydrocarbon polymers include mono and polyamines of about 2 to 60, e.g., 3 to 20, total carbon atoms and about 1 to 12, e.g., 2 to 6 nitrogen atoms in the molecule, which amines may be hydrocarbyl amines or may be hydrocarbyl amines including other groups, e.g., hydroxy groups, alkoxy groups, amide groups, imidazoline groups, and the like. Preferred amines are aliphatic saturated amines, including those of the general formulae:

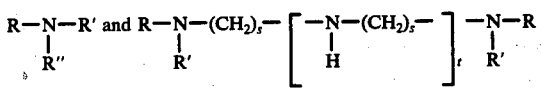

wherein R, R′ and R″ are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$to $C_{12}$ hydroxy or amino alkylene radicals; and $C_1$ to $C_{12}$ alkylamino $C_2$ to $C_6$ alkylene radicals; *s* is a number of from 2 to 6, preferably 2 to 4; and *t* is a number of from 0 10, preferably 2 to 6.

Non-limiting examples of suitable amine compounds include: mono-, di- and tri-tallow amines; 1,2-diaminoethane; 1,3-diaminopropane; 1,4-diaminobutane; 1,6-diaminohexane; diethylene triamine, triethylene tetraamine, tetraethylene pentamine; 1,2-propylene diamine; di(1,2-propylene) triamine; di-(1,3-propylene) triamine; N,N-dimethyl-1,3-diaminopropane; N,N-di-(2-aminoethyl) ethylene diamine; N,N-di-(2-hydroxyethyl)-1,3-propylene diamine; 3-dodecyloxypropylamine; N-dodecyl-1,3-propane diamine, tris-hydroxymethyl methylamine, diisopropanol amine, and diethanol amine.

Other useful amine compounds include: alicyclic diamines such as 1,4-di-(aminomethyl) cyclohexane, and heterocyclic nitrogen compounds such as imidazolines and N-aminoalkyl piperazines of the general formula:

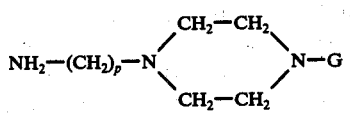

wherein G is independently selected from the group consisting of hydrogen and Ω-aminolkylene radicals of from 1 to 3 carbon atoms; and *p* is an integer of from 1 to 4. Non-limiting examples of such amines include 2-pentadecyl imidazoline; N-(2-aminoethyl) piperazine; N-(3-aminopropyl) piperazine; and N,N′-di-(2-aminoethyl) piperazine.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethylene amines) compounds having a composition approximating tetraethylene pentamine are available commercially under the trade name Polyamine 400 (PA-400) marketed by Jefferson Chemical Co., New York, n.Y. Similar materials may be made by the polymerization of aziridine, 2-methyl aziridine and azetidine.

Still other amines separated by hetero atom chains such as polyethers or sulfides can be used.

II Amino-Grafting of the Polymer

The grafting of polymers by mechanical means is old in the art. For the purposes of this invention, amino-grafting of the polymer may be done with a single piece of equipment, for example, e.g. a masticator, Banbury Mixer, rubber mill, extruder, homogenizer, etc. or may be done in stages with any of the said equipment. In the mechanically induced grafting device it is preferred to operate in the absence of a solvent or fluxing oil so that the polymer is readily exposed to the amine and used in an inert environment, i.e., an environment which does not provoke any substantial oxidation of the polymer during the mechanical grafting step. Useful equipment include Banbury mixers and mills having an adjustable gap, which devices may be closed to contain the amine and jacketed to provide heat through a medium such as superatmospheric steam, or heated oil or Dowtherm ®. The amino-grafting reaction is primarily dependent upon temperature and shearing time. The nitrogen content of the aminated polymer can be determined by conventional analytical means such as by: precipitating the polymer; separating the unreacted amine from the polymer; and, analyzing for nitrogen by the Kjeldahl technique.

When the amino-grafting reaction has reached the point at with the requisite level of nitrogen has been introduced into the polymer, a fluxing oil may be added to the aminated polymer. Usually enough oil is added to provide a concentration of aminated polymer in the range of about 5 weight percent to about 50 weight percent based on the weight of the total resulting solution for subsequent oxidation.

Useful temperatures for amino-grafting the polymers are in the range from about 95° C., preferably from about 150° to about 200° C. The time required to achieve satisfactory results will depend on the type of mechanical shearing equipment, the temperature of the polymer and particularly the speed of rotation if using a balde mixer as the grinding or masticating device. In this regard, we have found the Bramley Beken Blade Mixer to be particularly useful in providing in a single piece of equipment, the desired degree of amino grafting. This mixer, which is equipped with variable speed drive, has two rollers, fitted with helically disposed knives geared so that one roller revolves at one-half the speed of the other. The rollers are journaled in a jacketed reactor having two hemispherical halves in its base, which conforms to the radii of the two rollers. In this particular mixer, one can vary the revolutions per minute of the rollers. It has been found that the rpm of this masticator can vary from about 10 to about 150 for the faster roller and it is convenient to conduct the amino-grafting at a speed of about 52 for the fast roller and 26 for the slow roller. With the elevated temperature conditions set forth above, the time of mastication ranges from 0.5 to about 12 hours with from about 4 to about 5 hours found to be optimum. in carrying out the process of the invention, the environment for the mechanically induced amino-grafting of the polymer is to be inert, e.g., a nitrogen atmosphere. The amine is added to the mechanical device after the oxygen has been removed from the polymer and from the environment in which the amino grafting is to take place. This can be carried out, as for example, by mastication of the polymer under a nitrogen environment for upwards to 15 minutes so as to provide both the atmosphere free of oxygen and to remove from the polymer any occluded oxygen before introducing the amine compound into the system.

The amination can be conducted at pressures ranging from 0.1 to 20 atmospheres.

The amino-grafting step according to this invention can be accomplished without effecting chain length (molecular weight) degradation of the aminated polymer. Measurement of molecular weights and degradation thereof is for purposes of this disclosure evaluated by determination of the thickening efficiency of the polymer.

Thickening efficiency (T.E.) is defined as the ratio of the weight percent of a polyisobutylene (sold by Exxon Chemical Co., New York, N.Y. as PARATONE N®) having a Staudinger Molecular Weight of 20,000, required to thicken a solvent extracted neutral oil, having a viscosity of 150–105 SUS at 37.8° C., a viscosity index of 155 and an ASTM pour point of 0° F., (Solvent 150 Neutral) to a viscosity of 12.4 centistokes at 98.9° C., to the weight of a test copolymer required to thicken the same oil to the same viscosity at the same temperature.

IV. Oxidative Degradation of Aminated Polymer

The reduction in molecular weight of polymers by mechanical means is old in the art. For the purposes of this invention the mechanical-oxidative breakdowm of the aminated copolymer may be done with a single piece of equipment, or may be done in stages with increasing intensity of the degree of breakdown which takes place. It is preferred to operate in the absence of solvent or fluxing oil so the aminated polymer is readily exposed to air. Useful equipment includes Banbury mixers and mills having adjustable gaps, which devices may be enclosed in jacketed containers through which a heating medium may be passed such as superatmospheric steam, or heated Dowtherm®. When mastication or breakdown has reached a desired level, as determined by oxygen uptake and reduction in thickening efficiency (T.E.) as defined before, a fluxing oil may be added to the degraded polymer. Usually enough oil is added to provide a concentration of degraded polymer in the range of about 5 weight percent to 50 weight percent based on the weight of the total resulting solution. The resulting oil solution may thereafter be utilized as an article of commerce.

Useful temperatures for mechanical-oxidative degrading of the aminated polymers are in the range of about 95° C to 260° C. the time required to achieve satisfactory results will depend on the type of degrading or mastication equipment. the temperature of degrading, and particularly the speed of rotation if using a blade mixer as the degrading or masticating device. In this regard, we have found the Bramley Beken Blade Mixer to be particularly useful in providing in a single piece of equipment, the desired degree of mastication, or milling and oxidative degradation. This mixer, which is equipped with a variable speed drive, has two rollers, fitted with helically disposed knives geared so that one roller revolves at one-half the speed of the other. The rollers are journaled in a jacketed reactor having two hemispherical halves in its base, which conform to the radii of the two rollers. Superheated steam, or heated Dowtherm®, may be circulated through the jacket to provide the desired temperature. With this mixer satisfactory reductions in thickening efficiency may be obtained in from 0.25 to 20 hours in the temperature range of about 95° C. to 260° C.

Another approach as earlier indicated is to carry out the mechanical-oxidative degradation in solution with ordinary stirring or gas mixing. This can be conveniently carried out by heating the aminated polymer as a fluid solution (such polymer in an inert solvent) obtained at the conclusion of the amination step with oxygen or air. A mixture of oxygen and an inert gas such as nitrogen or carbon dioxide may be used. The inert gas then functions of a carrier of oxygen and often provides a convenient means of introducing oxygen into the reaction mixture. The oxygen or air may be introduced by bubbling through the polymer solution. However, it is frequently preferred to merely blow air over the surface of the solution while subjecting it to shearing agitation.

The inert solvent used in preparing the fluid solution of the aminated polymer is preferably a liquid hydrocarbon such as naphtha, hexane, cyclohexane, dodecane, mineral oil, biphenyl, xylene or toluene, a lubricating oil of the solvent neutral type, a white lubricating oil, chlorinated solvents such as dichlorobenzene, Isopars®, etc. The amount of the solvent is not critical so long as a sufficient amount is used to result in the fluid solution of the aminated polymer so as to facilitate the mechanicaloxidative degradation. Such a solution as earlier described usually contains from about 50 to about 95 weight percent of the solvent.

The oil-soluble aminated polymeric additives of this invention can be incorporated in lubricating oil compositions, e.g., automotive or diesel crankcase lubricating oil, in concentrations within the range of about 0.01 to 20 weight percent, e.g., 0.1 to 15.0 weight percent, preferably 0.25 to 10.0 weight percent of the total composition. The lubricants to which the aminated products of this invention can be added include not only hydrocarbon oil derived from petroleum, but also include synthetic lubricants such as: alkyl esters of dibasic acids; complex esters made by esterification of monobasic acids, polyglycols, dibasic acids and alcohols; esters of carbonic and phosphoric acids; carboxylic esters of polyglycols; etc.

These aminated polymeric additives can be advantageously incorporated in fuels, such as middle distillate fuels, at concentrations of from about 0.001 to about 0.5 weight percent and higher, preferably from about 0.005 to 0.2 weight percent, of the total composition. These aminated polymeric additives can contribute our point depressant and/or dispersant activity to the fuel.

The aminated polymers may be prepared in a concentrate form, e.g., from about 20 weight percent to about 49 weight percent in oil, e.g., mineral lubricating oil, for ease of handling.

The above concentrates may contain other conventional additives, such as dyes, our point depressants, antiwear agents, antioxidants, other viscosity-index improvers, dispersants and the like.

This invention will be further understood by reference to the following examples which include preferred embodiments of the instant invention.

EXAMPLE 1

Six pounds of copolymers of ethylene and propylene having an ethylene content of about 55 weight percent and a T.E. of 2.86 was put into a masticator which was a 2.5 gallon Bramley Beken Blade Mixer, fitted with a 5 H.P. Reeves varispeed motodrive geared to provide a speed at the mixer of from about 13 to 150 rpm. The masticator was heated with a steam jacket to 140°–152° C. and the 6 pounds of copolymer was masticated for about 15 minutes under a nitrogen atmsophere. Thereafter 15 grams of diethylene tetraamine was added over a 15 minute period. The mastication was continued with the fast blade having a rpm of 52 and the slower blade having an rpm of 26 which mastication continued for 3.75 hours under the nitrogen blanket. At this time, a sample of the amino-grafted polymer was analyzed and found to have a T.E of 2.86 and a nitrogen content of 0.02 weight percent. Thereafter an air atmosphere was introduced to replace the nitrogen blanket. Mastication was then continued at the above mechanical and temperature conditions of 160°–186° C. for 3.25 hours. At the end of the total run the T.E. of the aminated oxydegraded polymer, which had a nitrogen content of about 0.02 weight percent had been reduced to 1.0.

EXAMPLES 2–6

Five runs following the procedure of Example 1 were made using several other amine compounds. The results of these five runs are set forth in Table I.

TABLE I

| Amino Compound | | | Amination Conditions | | Mechanical-Oxidative Conditions | | Reaction Product | |
|---|---|---|---|---|---|---|---|---|
| Example | Name | Amount Added gs. | Time hr. | Temp. °C | Time hr. | Temp. °C | T.E. | %N |
| 2 | Diethylene triamine | 15.4 | 4 | 163–182 | 2.25 | 175–188 | 1.42 | 0.04 |
| 3** | PA-400 | 17.3 | 4 | 174–182 | 3.5 | 177–182 | 1.36 | 0.01 |
| 4 | PA-400 | 11.2 | 2.5 | 185 | 2.5 | 185 | 1.39 | 0.09 |
| 5 | Tetraethylene pentaamine | 10.3 | 5 | 174–188 | 3.0 | 177–188 | 1.38 | 0.07 |
| 6 | Triethylene tetraamine | 9.8 | 5 | 182–189 | 3.0 | 170–185 | 1.36 | 0.05 |

*Polyamine 400 (PA-400)
**Speed of fast blade modified to 32 rpm; slower blade at 16 rpm The invention described herein has broader applications than the dispersancy-sludge inhibition-V.I. improving properties of the reaction products that can be achieved through the incorporation of other moieties that would provide other performance characteristics of lubricating oils such as rust-inhibition, oxidative-stability, etc. Further these moieties can be introduced to modify the physical and chemical properties of the reaction products in non-lubricating oil applications to provide such performance characteristics such as adhesion (e.g. by means of acid functionality), dyeability, water shedding, polymer compatibility, etc. Other applications of the polymer additives are in automatic transmission fluids, gear oils, industrial oils, etc.

It is to be understood that the examples persent in the foregoing specification are merely illustrative of this invention and are not intended to limit it in any manner; nor is the invention to be limited by any theory regarding its operability. The scope of the invention is to be determined by the appended claims.

What is claimed is:

1. In a process for aminating and thereafter decreasing the molecular weight of an olefin copolymer to form an oil-soluble aminated copolymer useful as a sludge dispersing-viscosity index improving, additive for lubricating oil, the improvement which comprises: (a) carrying out said amination without substantial molecular weight degradation of said copolymer by mechanically working a mixture consisting essentially of amine and said copolymer at a temperature of about 130° to 260° C., under an inert gas atmosphere, for about 0.5 to 12 hours to thereby incorporate about 0.01 to 0.5 weight percent nitrogen into said copolymer, wherein said copolymer is a copolymer having a number average molecular weight in the range of about 700 to 250,00 and consists essentially of ethylene in an amount in the range of 2 to 98 wt. %, and one or more $C_3$ to $C_{28}$ alpha-olefins, and wherein said amine is a saturated, aliphatic hydrocarbyl polyamine of 3 to 20 carbon atoms and 2 to 6 nitrogen atoms; and, (b) thereafter, mechanically-oxidatively degrading said copolymer product in the presence of an oxygen-containing gas and at an elevated temperature in the range of about 95° C. to 260° C. for a period of from about 0.25 to 20 hours whereby the number average molecular weight of said copolymer is reduced.

2. A process according to claim 1, wherein said amine has the general formulae:

$$H-\underset{\underset{H}{|}}{N}-(CH_2)_s-\left[-\underset{\underset{H}{|}}{N}(CH_2)_s-\right]_t-\underset{\underset{H}{|}}{N}-H;$$

and wherein $s$ is 2 to 6 and $t$ is 0 to 10 and said oxygen-containing gas is air.

3. A process according to claim 2, wherein said amination temperature is about 150° to 200° C., said amination time is about 4 to 5 hours, said amine is tetraethylene pentamine, said copolymer is an ethylenepropylene copolymer and said degrading step is conducted in the absence of solvent or fluxing oil.

4. A process according to claim 2, wherein said amination temperature is about 150° to 200° C. said amination time is about 4 to 5 hours, said amine is diethylene triamine, said copolymer is an ethylenepropylene copolymer and said degrading step is conducted in the absence of solvent of fluxing oil.

5. A process according to claim 2, wherein said amination temperature is about 150° to 200° C., said amination time is about 4 to 5 hours, said amine is triethylene tetraamine, said copolymer is an ethylenepropylene copolymer and said degrading step is conducted in the absence of solvent or fluxing oil.

* * * * *